US007255231B2

(12) United States Patent
Andrews et al.

(10) Patent No.: US 7,255,231 B2
(45) Date of Patent: Aug. 14, 2007

(54) EGG CARTON

(75) Inventors: Alan P. Andrews, Mundelein, IL (US); David Furstoss, Gurnee, IL (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

(21) Appl. No.: 10/749,712

(22) Filed: Dec. 31, 2003

(65) Prior Publication Data

US 2005/0145529 A1 Jul. 7, 2005

(51) Int. Cl.
*B65D 85/32* (2006.01)

(52) U.S. Cl. ..... 206/521.1

(58) Field of Classification Search ..... 206/521.1, 206/509, 511, 512, 521.15; 220/4.23, 508
See application file for complete search history.

(56) References Cited

U.S. PATENT DOCUMENTS

| | | | |
|---|---|---|---|
| 3,100,593 | A | 8/1963 | Alsman |
| 3,145,896 | A | 8/1964 | Reifers et al. |
| 3,185,370 | A | 5/1965 | Reifers et al. |
| 3,223,306 | A | 12/1965 | Alsman |
| 3,501,083 | A | 3/1970 | Lake |
| 3,506,182 | A | 4/1970 | Snow et al. |
| 3,519,189 | A | 7/1970 | Bambara et al. |
| 3,563,450 | A | 2/1971 | Dahlberg |
| 3,567,107 | A | 3/1971 | Artz |
| 3,643,855 | A | 2/1972 | Donaldson |
| 3,735,917 | A | 5/1973 | Warburton |
| 3,771,712 | A | 11/1973 | Richards |
| 3,779,370 | A | 12/1973 | Snow et al. |
| 3,790,062 | A | 2/1974 | Boyd |
| 3,817,441 | A | 6/1974 | Jackson |
| 4,015,766 | A | 4/1977 | Petersen |
| 4,102,452 | A | 7/1978 | Sato et al. |
| 4,194,682 | A | 3/1980 | Congleton et al. |
| 4,240,575 | A | 12/1980 | Tange |
| 4,363,403 | A | 12/1982 | Raucci, Jr. et al. |
| 4,382,536 | A | 5/1983 | Congleton |
| 4,396,147 | A | 8/1983 | Jackson |
| 4,419,068 | A | 12/1983 | Congleton |
| 4,446,088 | A | 5/1984 | Daines |
| 4,549,656 | A | 10/1985 | Barnes et al. |
| 4,598,530 | A | 7/1986 | Barnes et al. |
| 4,625,906 | A | 12/1986 | Mangla |
| 4,625,907 | A | 12/1986 | Mangla |
| 4,742,953 | A | 5/1988 | Jacobs et al. |
| 4,872,608 | A | 10/1989 | Lake |
| 5,494,164 | A | 2/1996 | Ramirez |
| 5,575,399 | A | 11/1996 | Intini |
| 5,586,677 | A | 12/1996 | Foos |
| 5,848,699 | A | 12/1998 | Pattersson |
| 6,012,583 | A | 1/2000 | Ramirez |

(Continued)

*Primary Examiner*—Mickey Yu
*Assistant Examiner*—Jerrold Johnson
(74) *Attorney, Agent, or Firm*—Baker Botts L.L.P.

(57) ABSTRACT

An egg carton comprises a base having a plurality of egg cells, the base being attached to a lid and locking flap by at least one hinge member. The lid has a plurality of closing apertures adapted to receive a plurality of buttons located on the locking flap. The lid further has an outer closure mechanism adapted to interlock with an inner closure mechanism located on the locking flap. The egg carton may also be equipped with a venting system.

18 Claims, 5 Drawing Sheets

U.S. PATENT DOCUMENTS

| | | | |
|---|---|---|---|
| 6,086,931 | A | 7/2000 | Whiteford |
| 6,276,531 | B1 | 8/2001 | Andrews |
| 6,312,368 | B1 | 11/2001 | Wood et al. |
| 6,419,089 | B1 | 7/2002 | Dall |
| D466,802 | S | 12/2002 | Davkovski |
| 6,488,152 | B1 | 12/2002 | Steffann |
| 6,520,331 | B2 | 2/2003 | Okin et al. |
| 2002/0117507 | A1 | 8/2002 | Doerfler et al. |
| 2003/0015451 | A1 | 1/2003 | Sencer et al. |

EGG CARTON

FIELD OF THE INVENTION

This invention is directed generally to egg cartons, and more particularly to an egg carton having a two-way locking mechanism.

BACKGROUND OF THE INVENTION

Egg cartons are common in grocery stores around the world. Egg cartons have been known to open accidentally during handling, causing the contents to spill from the carton. This accidental opening must be accounted for in the design of the carton.

Additionally, eggs are placed into cartons while they are still warm. These filled cartons are then placed into refrigerating units to cool the eggs to acceptable temperatures. It is in the producers' and distributors' best interest to cool the eggs as quickly and efficiently as possible, and to minimize the effects of condensation during cooling and maintain egg quality. Thus, a need exists for a newly designed egg carton.

SUMMARY OF THE INVENTION

According to one embodiment of the invention, an egg carton with a two-way closure mechanism for securely closing the carton is disclosed. The egg carton comprises a base having a plurality of egg cells, the base being attached to a lid and locking flap by at least one hinge member. The lid has a plurality of closing apertures adapted to receive a plurality of buttons located on the locking flap. The lid further has an outer closure mechanism adapted to interlock with an inner closure mechanism located on the locking flap. The inner and outer closure mechanisms are designed so that a force on the exterior of the lid—in the direction required to disengage the buttons from the closing apertures—will prevent the inner and outer closure mechanisms from disengaging.

In another embodiment, an egg carton is equipped with a plurality of hinge members, wherein the first hinge member is substantially centered along the longitudinal dimension of the egg carton and second and third hinge members are offset from the first hinge member along the longitudinal dimension. The hinge members comprise a first end wall attached to a first container portion, wherein the first container portion is a lid having an upper lip, a second end wall attached to a second container portion, wherein the second container portion is a base having a lower lip and a plurality of egg cells, and a thinned area located within the hinge member between the first end wall and the second end wall. The hinge member is adapted to ensure that the upper lip of the first container portion contacts the lower lip of the second container portion.

In another embodiment, an egg carton is equipped with a venting system. The base of the egg carton contains a plurality of egg cells, posts, and venting areas. The base of the egg carton is attached to a lid and locking flap. The lid has a plurality of closing apertures adapted to receive a plurality of buttons located on the locking flap. The closing apertures are larger in size than the buttons so as to create a plurality of venting apertures. The venting areas of the base are lower than the venting apertures of the lid.

In another embodiment, a container is secured by positioning a lock flap in a substantially upright position, moving a lid toward the upright lock flap, inserting a plurality of buttons into a plurality of closing apertures, and closing the container by interlocking an outer closure mechanism and an inner closure mechanism, wherein the plurality of buttons extend in a first direction and a member of the outer closure mechanism extends in a second direction approximately opposite the buttons.

DETAILED DESCRIPTION OF THE ILLUSTRATED EMBODIMENT

Figure 1:
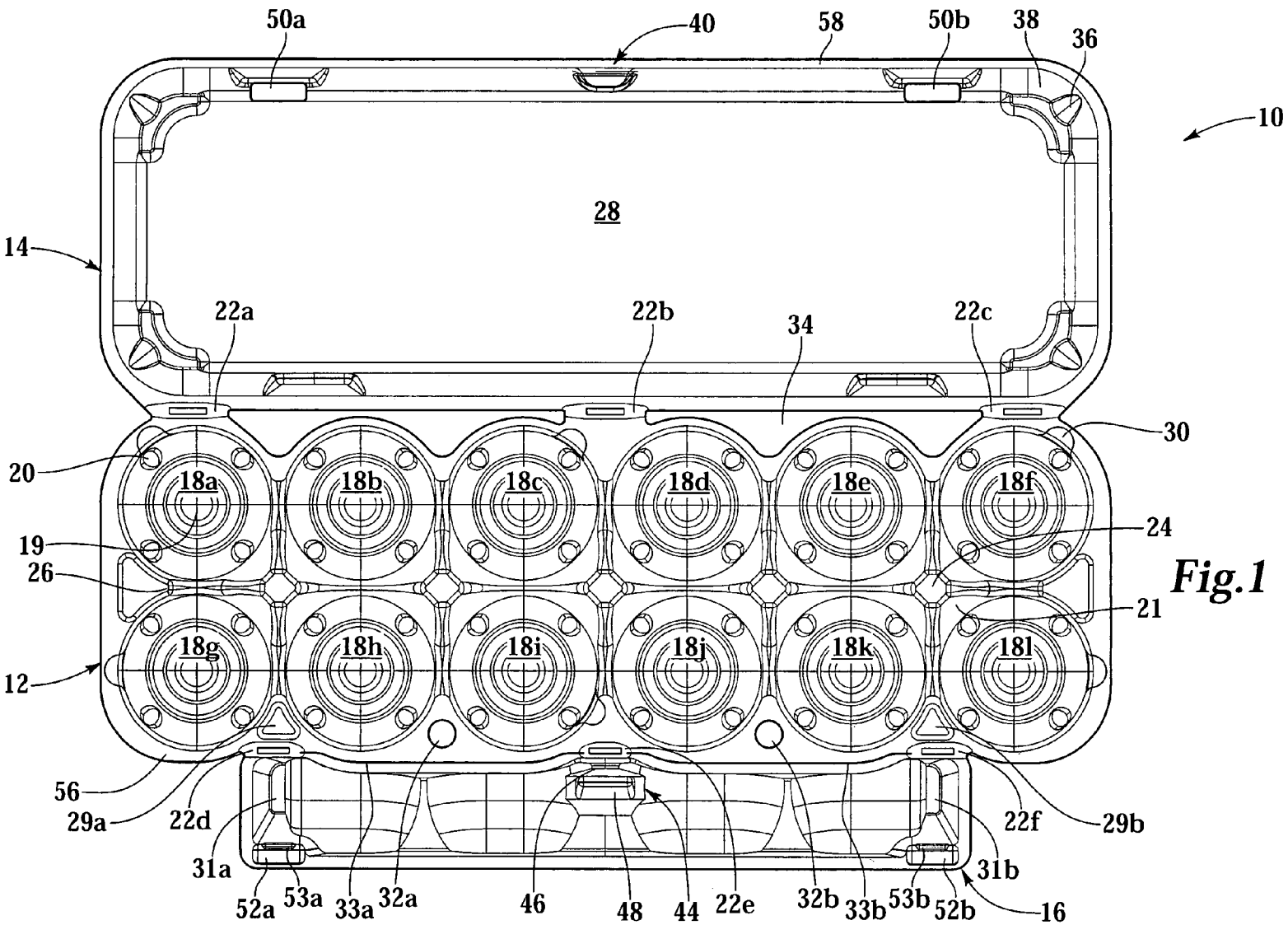
FIG. 1 is a top view of an open egg carton according to one embodiment of the present invention.
Figure 6A:
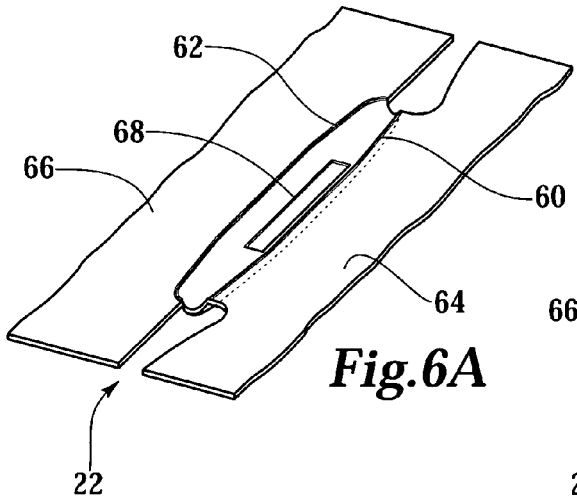
FIG. 6*a* is a perspective view of an open hinge member according to one embodiment of the present invention.
Figure 6B:
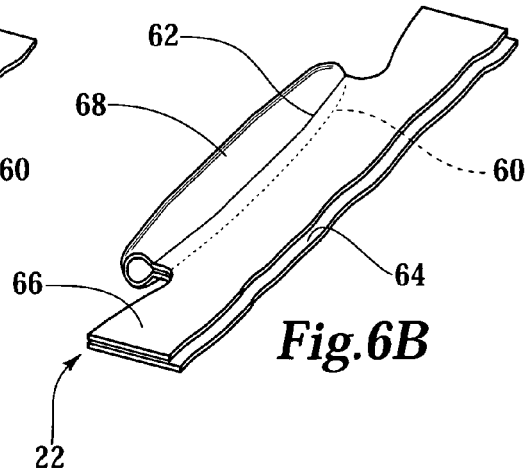
FIG. 6*b* is a perspective view of the hinge member of FIG. 6*a*, in a closed configuration.

Referring now to the drawings, and initially to FIG. 1, an egg carton 10 according to one embodiment of the present invention is shown. The egg carton 10 is comprised of a base 12 connected to a lid 14 and a locking flap 16. The base 12 contains a plurality of individual egg cells 18*a-l* adapted to seat eggs. The lid 14 and locking flap 16 are attached to the base 12 by a plurality of hinges 22 (FIGS. 6*a* and 6*b*). The lid 14 is attached to the rear of the base 12 by a plurality of hinge members 22*a-c*. The locking flap 16 is attached to the front of the base 12 by a plurality of hinge members 22*d-f*. In one embodiment, each of the lid 14 and locking flap 16 is attached to the base 12 by three hinge members 22*a-f*. Slits 33*a* and 33*b* are located between the base 12 and the locking flap 16 and allow the locking flap 16 to be raised into a substantially upright position. The egg carton may be composed of a plastic, thermoplastic, Styrofoam or any other suitable material.

In one embodiment, the base 12 contains twelve egg cells 18*a-l* positioned in two equal rows. The egg cells 18*a-l* contain crumple areas. The crumple areas may be formed by positioning a raised seat 19 in the center of the floor of each cell. This seat 19 forms the lowest point at which an egg can be inserted into the cell. The distance between the floor of each cell and the raised seat 19 is the crumple area and serves to protect the eggs from being damaged during loading, stacking, transporting, displaying, and using the carton.

The cells may also be equipped with projections 20 to prevent the eggs from resting against the outer wall of each cell. These projections 20 may be adapted to prevent the egg from contacting the raised seat 19 as well. In this embodiment, the raised seat 19 would still be the lowest point an egg could be inserted were the egg to be smaller than expected or forced into the cell. The projections 20 are also useful in allowing air to circulate around substantially all of the egg. Specifically, the heat emitted and any condensation formed beneath the seated egg is allowed to escape from the crumple area into the upper areas of the carton 10. Within each quadrant of egg cells 18*a-l*, a post 21 is positioned. The posts 21 comprise flat faces 24 with ridges 26 projecting downwardly from the faces 24. The ridges 26 are spaced about 90° from one another and align with the inner walls of the egg cells 18*a-l*. When the carton 10 is closed, the ceiling of lid 14 rests upon the faces 24 of the posts 21. Thus, the posts 21 provide vertical protection for the seated eggs and lend support to the lid 14 when the lid 14 is closed. This additional interior support is particularly useful when stacking multiple filled cartons 10.

The lid 14 is also provided with exterior support in the form of corner indentations 36. These indentations 36 provide structural integrity to the carton 10 even when multiple cartons are stacked atop the carton 10. To assist in stacking and to is stabilize existing stacks, the lid 14 contains ledges 38 at each corner. The ledges 38 are adapted to receive a corner cell and prevent the stacked carton from sliding off from atop the carton 10.

The base 12 is provided with nubs 29*a* and 29*b* which help align the locking flap 16 for closing. The nubs 29*a* and 29*b* are designed to assist a user in positioning the locking flap 16 in the proper vertical position for closing the carton 10. Further, the nubs 29*a* and 29*b* serve as tensioning devices for the closures of the present invention. The locking flap 16 is provided with inner projections 31*a* and 31*b* which are adapted to rest against the nubs 29*a* and 29*b* and align the locking flap 16 for closure of the lid 14.

In one embodiment, the base 12 also contains a plurality of denesting lugs 30 which assist in the unstacking of empty cartons during labeling and when filling the carton with eggs. The use of denesting lugs 30 reduces the likelihood of a vacuum being formed between empty, stacked cartons. The denesting lugs 30 also minimize surface contact such that excessive nesting is avoided. As will be appreciated by one skilled in the art, the denesting lugs 30 can be in a variety of locations and in varying quantities. At least two configurations of denesting lugs 30 should be used and these configurations should be alternated when stacking empty cartons for shipping. In one embodiment, the cartons 10 are equipped with three different configurations, A, B, and C. In this embodiment, the cartons would be repetitively stacked ABCABCABC, etc. In another embodiment, four different configurations are used for the denesting lugs 30.

Figure 4A:
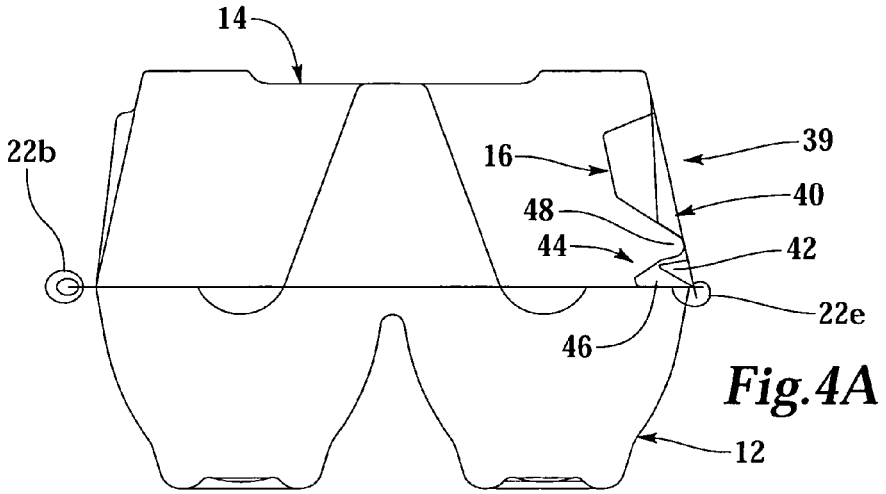
FIG. 4*a* is a cross sectional view of a reciprocal locking mechanism.

The carton 10 is provided with a reciprocal closure mechanism 39 (FIG. 4*a*) for securing the lid 14 to the locking flap 16. Referring now to FIG. 4*a*, a reciprocal closure mechanism 39 for securing the lid 14 to the locking flap 16 is shown. The lid 14 is provided with an outer closure element 40 having an inwardly extending member 42. The outer closure element 40 is adapted to interlock with an inner closure element 44 located on the locking flap 16. The inner closure element 44 has an inwardly recessed pocket 46 adapted to receive the inwardly extending member 42. In one embodiment, the inner closure element 44 includes an outwardly extending member 48 above the recessed pocket 46.

The inwardly extending member 42 of the outer closure element 40 is received by the inwardly recessed pocket 46 of the inner closure element 44. In this position, the outwardly extending member 48 of the inner closure element 44 is located above the inwardly extending member 42 of the outer closure element 40 and further ensures the secure closure of the carton 10.

Figure 4B:
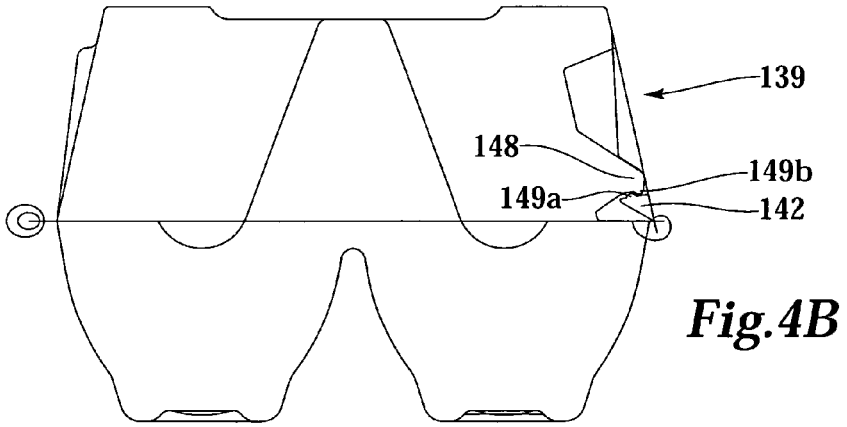
FIG. 4*b* is a cross sectional view of a reciprocal locking mechanism according to another embodiment of the present invention.

Referring now to FIG. 4*b*, in one embodiment of the reciprocal closure mechanism 139, the inwardly extending member 142 of the outer closure element 40 and the outwardly extending member 148 of the inner closure element 44 contain reciprocally projecting feet 149*a*, 149*b* to further ensure a secure closure. In this embodiment, the foot 149*a* on the inwardly extending member 142 projects upwardly and behind the foot 149*b*, which projects downwardly from the outwardly extending member 148. These corresponding feet 149*a*, 149*b* require a user to apply more force to open the carton; further preventing the unintentional opening of the carton during handling and shipping.

Figure 2:
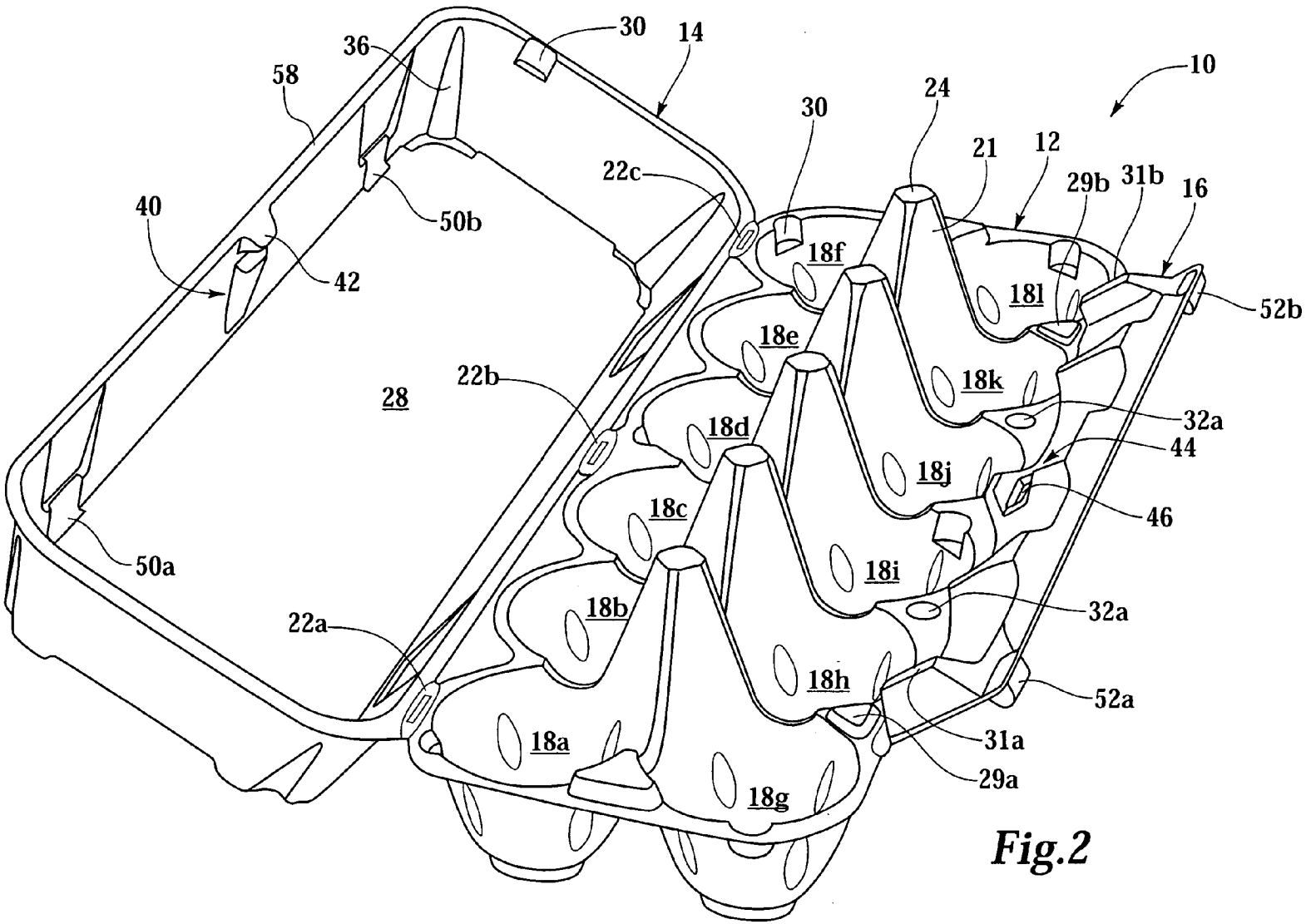
FIG. 2 is a perspective view of the egg carton of FIG. 1, in a partially opened configuration.
Figure 3:
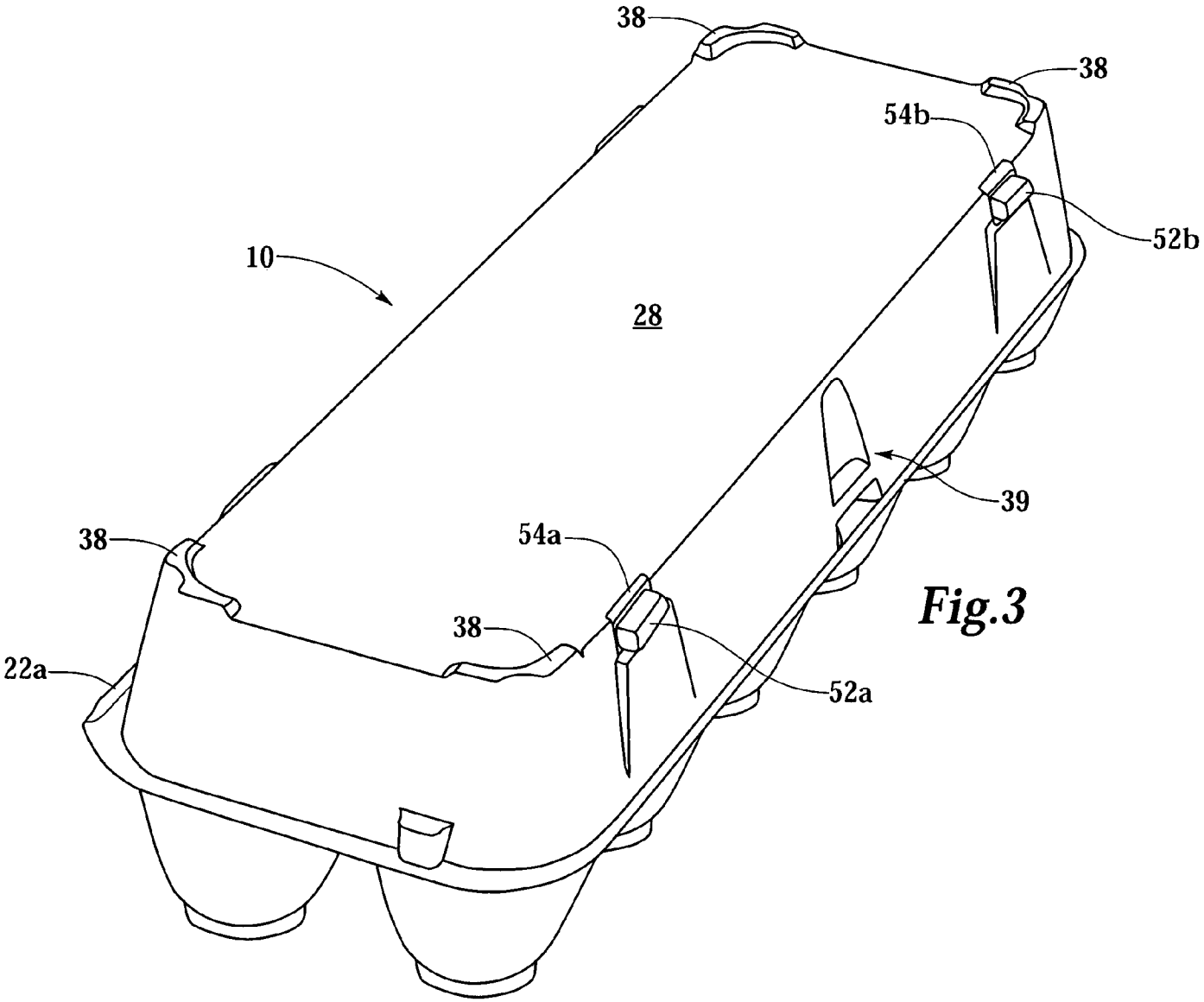
FIG. 3 is a perspective view of the egg carton of FIG. 1, in a closed configuration.

Referring now to FIG. 2, the lid 14 also contains closing apertures 50*a* and 50*b*. The closing apertures 50*a*, 50*b* are adapted to receive buttons 52*a* and 52*b* located on the locking flap 16. The buttons 52*a*, 50*b* each have a downwardly projecting foot 53*a* and 53*b* (FIG. 1) which helps secure the lid 14 to the locking flap 16. The feet 53*a*, 53*b* help prevent the buttons 52*a*, 52*b* from slipping out of the closing apertures 50*a*, 50*b*. The closing apertures 50*a*, 50*b* are larger in size than the buttons 52*a*, 52*b*, thus creating venting apertures 54*a* and 54*b* above the projecting buttons 52*a*, 52*b*, as shown in FIG. 3.

The use of the closing apertures 50*a*, 50*b* and buttons 52*a*, 52*b* in combination with the reciprocal closure mechanism 39 creates a two-way closure for the egg carton 10. The inner and outer closure elements 44, 40 are designed so that a force on the exterior of the lid 14—in the direction required to disengage the buttons 52*a*, 52*b* from the closing apertures 50*a*, 50*b*—will prevent the reciprocal closure mechanism 39 from disengaging. The reciprocal closure mechanism 39 prevents the carton from accidentally opening, even when the carton 10 is picked up from the top (e.g., when a user only grasps the closed lid during lifting and handling the carton). In fact, the reciprocal closure mechanism 39 will cause the carton 10 to be even more difficult to open when a user is applying an inward force to the lid 14 (e.g., grasping the lid).

In another embodiment of the present invention, the outer closure element 40 consists of an inwardly extending locking button, similar to the outwardly extending buttons 52*a*, 52*b* shown in FIG. 2. The inwardly extending locking button of this embodiment replaces the inwardly extending member 42 shown in FIG. 2. In this embodiment, the inner closure element 44 on the locking flap 16 consists of a locking aperture, similar to the closing apertures 50*a*, 50*b* shown in FIG. 2. In this embodiment, the locking aperture replaces the inwardly recessed pocket 46 and the outwardly extending member 48 shown in FIG. 1. The inwardly extending locking button also comprises an upwardly extending foot which helps secure the locking button from disengaging from the locking aperture when the carton 10 is in its closed position. As described above, the reciprocal closure element will help prevent the carton from opening accidentally. In this embodiment, when the user applies an inward pressure to the lid 14, the locking button is forced further into the locking aperture, thus further securing the carton 10 in its closed position.

Figure 5C:
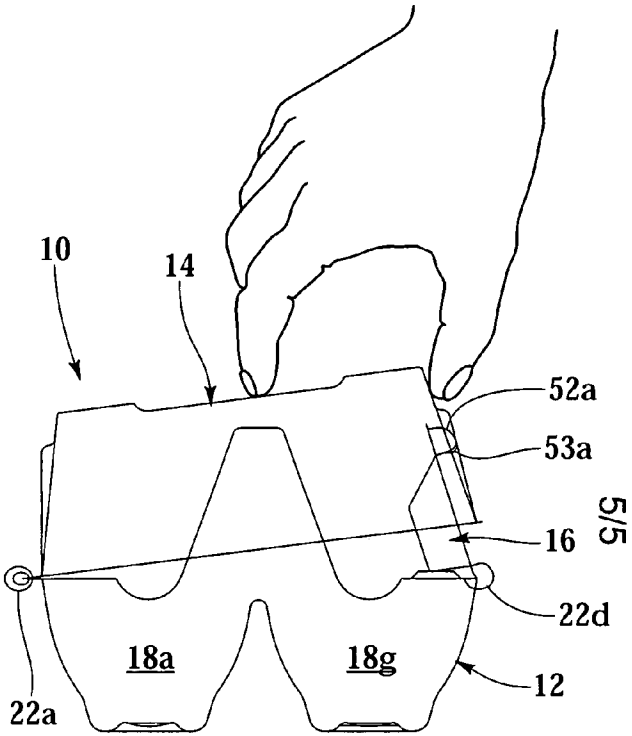
FIG. 5*c* is a side view of the egg carton of FIG. 5*b* after a user begins to open the carton.
Figure 5B:
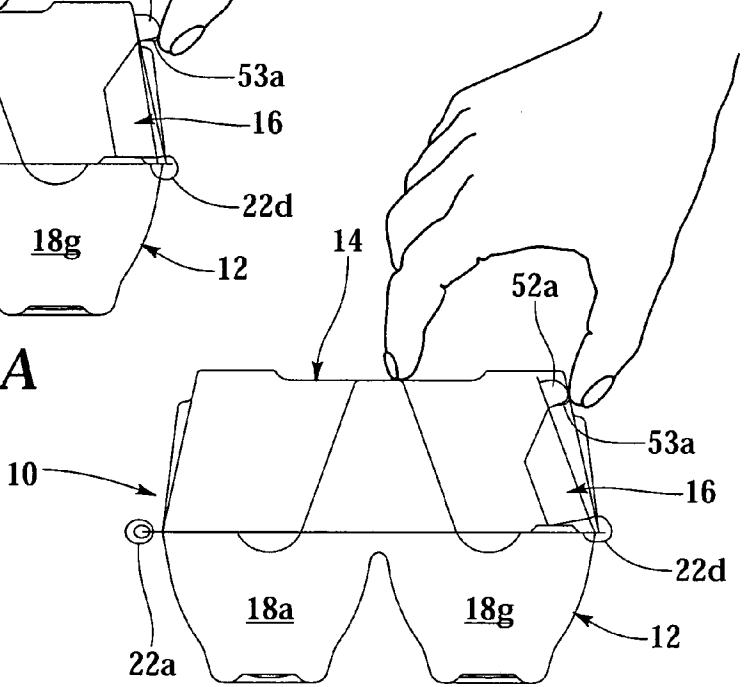
FIG. 5*b* is a side view of the egg carton of FIG. 5*a* after a user applies an inward pressure to the buttons.
Figure 5A:
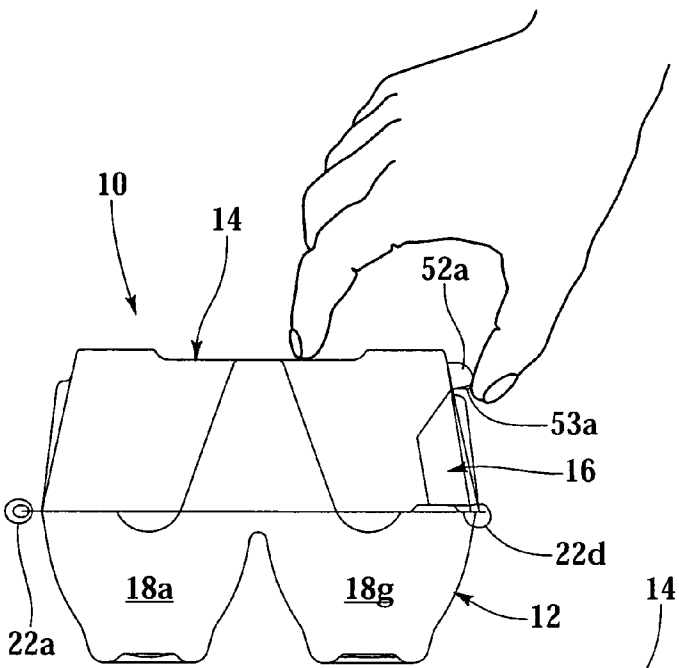
FIG. 5*a* is a side view of the egg carton of FIG. 1, in a closed configuration.

Referring now to FIGS. 5*a-c*, the operation of the closing devices—according to one embodiment of the present invention—on the locking flap 16 and lid 14 of an egg carton 10 are shown. FIG. 5*a* shows an egg carton in its closed position. The button 52*a* projects through the closing aperture 50*a* (FIG. 1). In this position, the inwardly extending member 42 of the outer closure element 40 is located within the inwardly recessed pocket 46 of the inner closure element 44 (FIG. 4*a*). To open the carton 10, a user applies an inward pressure to the button 52*a*, as shown in FIG. 5*b*. In the embodiment illustrated in FIGS. 1-3, a user must also apply an inward pressure to the button 52*b* to disengage the button 52*b* from the closing aperture 50*b*, prior to, along with, or after disengaging the button 52*a*. When one of the buttons 52*a* or 52*b* is disengaged from the closing aperture 50*a* or 50*b*, it will remain disengaged due to the upward force supplied by the hinges 22*a-c* to the lid 14. The inward pressure forces the buttons 50*a* and 52*b* (FIG. 3) to disengage from the closing apertures 50*a*, 52*b* (FIG. 2). Further, the inward pressure on the buttons 50*a*, 50*b* causes the locking flap 16 to move inward, thus disengaging the inwardly extending member 42 from the inwardly recessed pocket 46. The user can then lift the lid 14 to open the carton 10, as shown in FIG. 5*c*.

Referring again to FIG. 1, in one embodiment, the hinge members 22*d-f* are adapted to create an outward tension on the locking flap 16. In this embodiment, when the carton 10 is open, the locking flap 16 will be pulled slightly outward such that the lid 14 will not be able to interlock with the locking flap 16. In this embodiment, an inward force must be applied to the locking flap 16 to position the locking flap 16 for interlocking with the lid 14, thus closing the carton 10. Once the carton 10 is closed, the outward tensioning by the hinge members 22*d-f* ensures that the buttons 52*a*, 52*b* remain engaged with the closing apertures 50*a*, 50*b*.

In another embodiment, when the locking flap 16 is in an upright or closed position, the nubs 29*a*, 29*b* apply an outward pressure on the locking flap 16 which ensures that the buttons 52*a*, 52*b* engage and remain engaged with the closing apertures 50*a*, 50*b*. Thus, along with the outward tensioning by the hinge members 22*d-f*, the nubs 29*a*, 29*b* ensure that the carton 10 is securely closed.

In one embodiment of the present invention, the egg carton 10 is provided with a venting system. Referring now to FIG. 1, the rear exterior portion of the base 12 is designed to create venting areas 34. The base 12 is equipped with a lower lip 56 which runs along the perimeter of the base 12. The lid 14 is equipped with an upper lip 58 which runs along the perimeter of the lid 14. When the lid 14 is closed, the upper lip 58 contacts the lower lip 56. However, the venting areas 34 remain unobstructed and allow the flow of air into and out from the carton 10. The front of the lower lip 56 is provided with two venting holes 32*a* and 32*b*. In another embodiment, the front of the lower lip is designed to create venting areas analogous to those illustrated for the rear of the lower lip in FIG. 1. In other embodiments, slits 33*a* and 33*b* are adapted to create additional venting spaces when the locking flap 16 is substantially upright and the carton 10 is closed.

The combination of the venting holes 32*a*, 32*b*, venting areas 34, venting apertures 54*a*, 54*b*, projections 20, and venting spaces (if present) allows for faster cooling of the eggs upon placement of eggs into the carton 10. This combination of structures also assists in removing moisture and preventing condensation from forming within the carton 10. In usage, warm eggs (~80° F.) may be placed into the carton 10 and the lid 14 may then be closed. The carton may then be put into a corrugated case or other shipping container. These shipping containers are then placed into a refrigerating unit, having a temperature of, for example, at or below 40° F. for cooling. The venting holes 32*a*, 32*b* and venting areas 34 allow the refrigerated air to enter the carton 10. The projections 20 allow this cool air to replace the hotter air around and below the warm eggs. The heat released from the eggs rises to the top of the carton 10 where it exits through the venting apertures 54*a*, 54*b*. As the eggs continue to cool, any condensation that formed on or around the eggs is allowed to evaporate and escape in a similar manner. This configuration allows the eggs to cool along the distribution channel. This configuration also allows the eggs to cool in a quick and efficient manner, substantially free of condensation. Further, preventing condensation and allowing moisture to evaporate from the carton helps to prevent bacterial growth in the carton.

In one embodiment of the present invention, the lid 14 and locking flap 16 are each attached to the base 12 by three hinges 22*a-f*. In this embodiment, the lid 14 is attached to the rear of the base 12 by three hinge members 22*a-c*, while the locking flap 16 is attached to the front of the base 12 by three hinge members 22*d-f*. The central rear hinge member 22*b* is located at about the center of the egg carton 10, between egg cells 18*c* and 18*d*. The outside rear hinge members 22*a* and 22*c* are located on opposite sides of the central hinge member 22*b* and about the same distance from the central hinge member 22*b*. In this embodiment, the outside rear hinge members 22*a* and 22*c* are approximately centered in relation to the outside rear egg cells 18*a* and 18*f*. The central front hinge member 22*e* is located on the opposite side of the base 12 as the central rear hinge member 22*b*. The outside front hinge members 22*d* and 22*f* are about the same distance from the central hinge member 22*e* and located closer to the central hinge member 22*e* than the center of the outside front egg cells 18*g* and 181. Thus, the outside front hinge member 22*d* is located between egg cells 18*g* and 18*h* and the other outside front hinge member 22*f* is located between egg cells 18*k* and 181.

Referring now to FIG. 6*a*, a hinge member 22 according to one embodiment of the present invention is shown. The hinge member 22 is elliptically shaped and has a first end wall 60 and a second end wall 62. The first end wall 60 is attached to a first container portion 64 and the second end wall 62 is attached to a second container portion 66. The hinge member 22 is adapted to bring the first container portion 64 into contact with the second container portion 66 upon the closing of the hinge member 22, as shown in FIG. 6*b*.

A thinned area 68 is located at about the center of the hinge member 22. The thinned area 68 is used to ensure that the hinge member 22 bends in the correct location, thus facilitating proper alignment of the first container portion 64 with the second container portion 66. In one embodiment, the thinned area 68 is shaped as a rectangle and located in the center of the hinge member 22. In another embodiment, the thinned area has an elliptical shape. As appreciated by those skilled in the art, the thinned area may take on a variety of alternative shapes (e.g., oval, square, diamond) depending on the design requirements, intended usage of the hinge member and container, and the thickness of the material. Further, amount of material thinned from the hinge can be varied and may effect the choice of the shape for the thinned area. According to one embodiment of the present invention, egg cartons are manufactured having a material thickness of 20 mils.

The hinge member of the present invention may be composed of plastic, thermoplastic, Styrofoam, or any other suitable material. In other embodiments of the present invention, the thinned area is actually a thickened area of sufficient thickness to allow the hinge to bend at the correct location.

As discussed earlier, in one embodiment, the lid 14 is attached to the base 12 by three separate hinge members 22*a-c*. The locking flap 16 is also attached to the base 12 by three distinct hinge members 22*d-f*. The use of separate hinge members 22*a-f*, as opposed to a continuous hinge, allows for easier closure of the carton 10. Additionally, the creation of a thinned area 68 further reduces the amount of force necessary to close the carton 10, and assures proper alignment of the lid 14 and the base 12.

However, in other embodiments, a continuous hinge is used to attach the lid 14 and the locking flap 16 to the base 12. In other embodiments, a plurality of hinge members are used to attach the lid 14 and the locking flap 16 to the base 12. In other embodiments the hinge members may take on different shapes so long as the first container portion and second container portion are brought into contact with each other. In yet other embodiments the three hinge members are positioned at different locations than previously described. One of ordinary skill in the art will recognize that the hinge members can be varied according to the specific design needs and intended usage of the container.

In other embodiments, different numbers of egg cells may be incorporated into the egg carton such that there is at least one quadrant of cells. In other embodiments, the relative directions of the closures may be reversed so long as one closure member is reciprocal to the other closure member.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A two-way locking mechanism for a container comprising:

a locking flap having a plurality of buttons and an inner closure mechanism containing an inwardly recessed pocket and an outwardly extending member located above the inwardly recessed pocket;

a lid having a plurality of closing apertures adapted to receive the plurality of buttons, and further having an outer closure mechanism having an inwardly extended member adapted to be received by the inner closure mechanism of the locking flap;

wherein;

the plurality of buttons extend from the locking flap in a first direction and the outer closure mechanism extends from the lid in a second direction opposite the buttons when the locking mechanism is in a locked position; and the outwardly extending member of the inner closure mechanism of the locking flap is aligned above the inwardly extending member of the lid when the inwardly extending member of the lid is received by the inwardly recessed pocket.

2. The two-way locking mechanism of claim 1, wherein the outwardly extending member of the locking flap and the inwardly extending member of the lid have reciprocally projecting feet.

3. The two-way locking mechanism of claim 1 wherein the plurality of buttons are provided with feet to assist in securing the container in its closed position.

4. The two-way locking mechanism of claim 1 further comprising at least one nub, wherein the at least one nub applies an outward tension to the locking flap when the container is closed.

5. An egg carton with a two-way locking mechanism comprising:

a base having a plurality of egg cells;

a locking flap attached to the base by at least one hinge, the locking flap having a plurality of buttons and an inner closure mechanism containing an inwardly recessed pocket and an outwardly extending member located above the inwardly recessed pocket;

a lid attached to the base by at least one hinge, the lid having a plurality of closing apertures adapted to receive the plurality of buttons, and further having an outer closure mechanism having an inwardly extended member adapted to be received by the inner closure mechanism of the locking flap;

wherein:

the plurality of buttons extend from the locking flap in a first direction and the outer closure mechanism extends from the lid in a second direction opposite the buttons when the locking mechanism is in a locked position; and the outwardly extending member of the inner closure mechanism of the locking flap is aligned above the inwardly extending member of the lid when the inwardly extending member of the lid is received by the inwardly recessed pocket.

6. The egg carton of claim 5, wherein at least three hinge members attach the locking flap to the base.

7. The egg carton of claim 5, wherein at least three hinge members attach the lid to the base.

8. The egg carton of claim 5, wherein the carton is composed of a thermoplastic material.

9. The egg carton of claim 5, wherein the egg cells are equipped with projections adapted to allow air to circulate around substantially all of the egg.

10. The egg carton of claim 5, wherein the outwardly extending member of the locking flap and the inwardly extending member of the lid have reciprocally projecting feet.

11. The egg carton of claim 10 wherein the plurality of buttons are provided with feet to assist in securing the container in its closed position.

12. The egg carton of claim 5 further comprising at least one nub, wherein the at least one nub applies an outward tension to the locking flap when the container is closed.

13. The egg carton of claim 5, wherein the at least one hinge member applies outward tension to the locking flap when the carton is closed.

14. A method for securing a container having a two-way locking mechanism comprising the steps of:

positioning a locking flap in a substantially upright position, the locking flap having a plurality of buttons and an inner closure mechanism containing an inwardly recessed pocket and an outwardly extending member located above the inwardly recessed pocket;

moving a lid toward the upright lock flap, the lid having a plurality of closing apertures adapted to receive the plurality of buttons, and further having an outer closure mechanism having an inwardly extended member adapted to be received by the inner closure mechanism of the locking flap;

inserting the plurality of buttons into the plurality of closing apertures; and closing the container by interlocking the outer closure mechanism.and the inner closure mechanism, wherein the plurality of buttons extend in a first direction and the outer closure mechanism extends in a second direction approximately opposite the buttons; and the outwardly extending member of the inner closure mechanism of the locking flap is aligned above the inwardly extending member of the lid when the inwardly extending member is received by the inwardly recessed pocket.

15. The method of claim 14, wherein the positioning of the locking flap is assisted by nubs located on the base of the container.

16. The method of claim 14 further comprising providing an outward tension on the locking flap of the closed container.

17. The method of claim 14 wherein the outward tensioning is performed by at least one nub interacting with at least one projection attached to the lock flap.

18. The method of claim 14 wherein the tensioning is performed by at least one hinge member.

* * * * *